US006723221B2

(12) United States Patent
D'Astolfo, Jr. et al.

(10) Patent No.: US 6,723,221 B2
(45) Date of Patent: Apr. 20, 2004

(54) INSULATION ASSEMBLIES FOR METAL PRODUCTION CELLS

(75) Inventors: LeRoy E. D'Astolfo, Jr., Lower Burrell, PA (US); Thomas R. Hornack, Lower Burrell, PA (US); Raymond Miller, Lower Burrell, PA (US); Robert L. Kozarek, Apollo, PA (US)

(73) Assignee: Alcoa Inc., Pittsburgh, PA (US)

( * ) Notice: Subject to any disclaimer, the term of this patent is extended or adjusted under 35 U.S.C. 154(b) by 126 days.

(21) Appl. No.: 09/908,253

(22) Filed: Jul. 18, 2001

(65) Prior Publication Data

US 2002/0074235 A1 Jun. 20, 2002

Related U.S. Application Data

(60) Provisional application No. 60/219,711, filed on Jul. 19, 2000.

(51) Int. Cl.[7] ..... C25C 3/00; C25C 3/06; C25C 7/00; C25D 17/00; B01D 59/40

(52) U.S. Cl. ..... 205/367; 205/372; 205/396; 204/225; 204/243.1; 204/245; 204/279

(58) Field of Search ..... 204/243.1, 244, 204/245–247, 225, 279; 205/354, 372, 367, 396

(56) References Cited

U.S. PATENT DOCUMENTS

| | | | | |
|---|---|---|---|---|
| 2,480,474 A | | 8/1949 | Johnson | |
| 3,785,941 A | | 1/1974 | Jacobs | |
| 3,839,167 A | * | 10/1974 | Sleepy | 204/245 X |
| 3,996,117 A | * | 12/1976 | Graham et al. | 204/245 X |
| 4,097,228 A | | 6/1978 | Rosling | |
| 4,160,715 A | | 7/1979 | Kinosz et al. | |
| 4,187,155 A | | 2/1980 | de Nora et al. | |
| 4,222,841 A | | 9/1980 | Miller | |
| 4,342,178 A | | 8/1982 | Benton et al. | |
| 4,374,050 A | | 2/1983 | Ray | |
| 4,374,761 A | | 2/1983 | Ray | |
| 4,399,008 A | | 8/1983 | Ray | |
| 4,455,211 A | | 6/1984 | Ray et al. | |
| 4,582,585 A | | 4/1986 | Ray | |
| 4,584,172 A | | 4/1986 | Ray et al. | |
| 4,608,134 A | | 8/1986 | Brown | |
| 4,608,135 A | * | 8/1986 | Brown | 204/246 X |
| 4,620,905 A | | 11/1986 | Tarcy et al. | |
| 5,030,335 A | * | 7/1991 | Olsen | 204/245 X |
| 5,794,112 A | | 8/1998 | Ray et al. | |
| 5,865,980 A | | 2/1999 | Ray et al. | |
| 6,217,739 B1 | | 4/2001 | Ray et al. | |
| 6,402,928 B1 | * | 6/2002 | de Nora | 204/245 X |

FOREIGN PATENT DOCUMENTS

WO WO 99/02763 1/1999

OTHER PUBLICATIONS

Ray et al., U.S. Utility Patent Application Serial No. 09/629, 332 Entitled "Cermet Inert Anode Containing Oxide and Metal Phases Useful for the Electrolytic Production of Metals", Filed Aug. 1, 2000.

* cited by examiner

*Primary Examiner*—Donald R. Valentine
(74) *Attorney, Agent, or Firm*—Alan G. Towner; Tracey D. Beiriger

(57) ABSTRACT

Insulation assemblies provide reduced heat loss from electrolytic metal production cells such as inert anode aluminum production cells. The insulation assemblies may be located at the end, side and/or center aisles of the cell, and may be supported by the anodes and deckplate of the cell. The assemblies reduce heat loss and bath vaporization losses, and permit stable operation of the inert anode cell.

54 Claims, 10 Drawing Sheets

INSULATION ASSEMBLIES FOR METAL PRODUCTION CELLS

CROSS REFERENCE TO RELATED APPLICATION

This application is claims the benefit of U.S. Provisional Patent Application Ser. No. 60/219,711 filed Jul. 19, 2000.

FIELD OF THE INVENTION

The present invention relates to electrolytic metal production cells, and more particularly relates to insulation assemblies for inert anode aluminum production cells.

BACKGROUND INFORMATION

Existing aluminum smelting cells use consumable carbon anodes which produce $CO_2$ and other gaseous by-products and must be frequently replaced. Inert or non-consumable anodes may eliminate these concerns, but the implementation of inert anodes provides other challenges such as controlling the heat balance of the cell. In order to provide a viable retrofit design to utilize inert anodes in a standard carbon anode cell, it is necessary to significantly reduce overall heat losses.

SUMMARY OF THE INVENTION

The present invention provides reduced heat loss from metal production cells, such as inert anode aluminum production cells, through the use of insulation assemblies. The insulation assemblies may be located at the end, side and/or center aisles of the cell, and may be supported between the anodes and deckplate of the cell. The assemblies reduce heat loss and bath vaporization losses, and permit stable operation of the inert anode cell.

An aspect of the present invention is to provide a metal production cell comprising an electrolytic bath containment vessel, at least one anode assembly mounted over the vessel, and at least one insulation assembly located along a side aisle or end aisle of the vessel and supported by the at least one anode assembly.

Another aspect of the present invention is to provide an insulation assembly for an aluminum production cell. The insulation assembly comprises at least one deck plate support member, at least one inert anode assembly support member, and insulation material connected to the at least one deck plate support member and the at least one inert anode assembly support member.

A further aspect of the invention is to provide a method of thermally insulating an aluminum production cell. The method comprises the steps of providing an electrolytic bath containment vessel, providing at least one anode assembly over the vessel, and installing at least one insulation assembly along a side aisle or end aisle of the vessel supported by the at least one anode assembly.

These and other aspects of the present invention will be more apparent from the following description.

DETAILED DESCRIPTION

In accordance with the present invention, insulation assemblies are used to reduce heat loss from electrolytic metal production cells. Although aluminum production cells comprising inert anode assemblies are primarily described herein, it is to be understood that the present insulation assemblies may be used with other types of metal production cells, as well as conventional consumable anode aluminum production cells.

Figure 1:
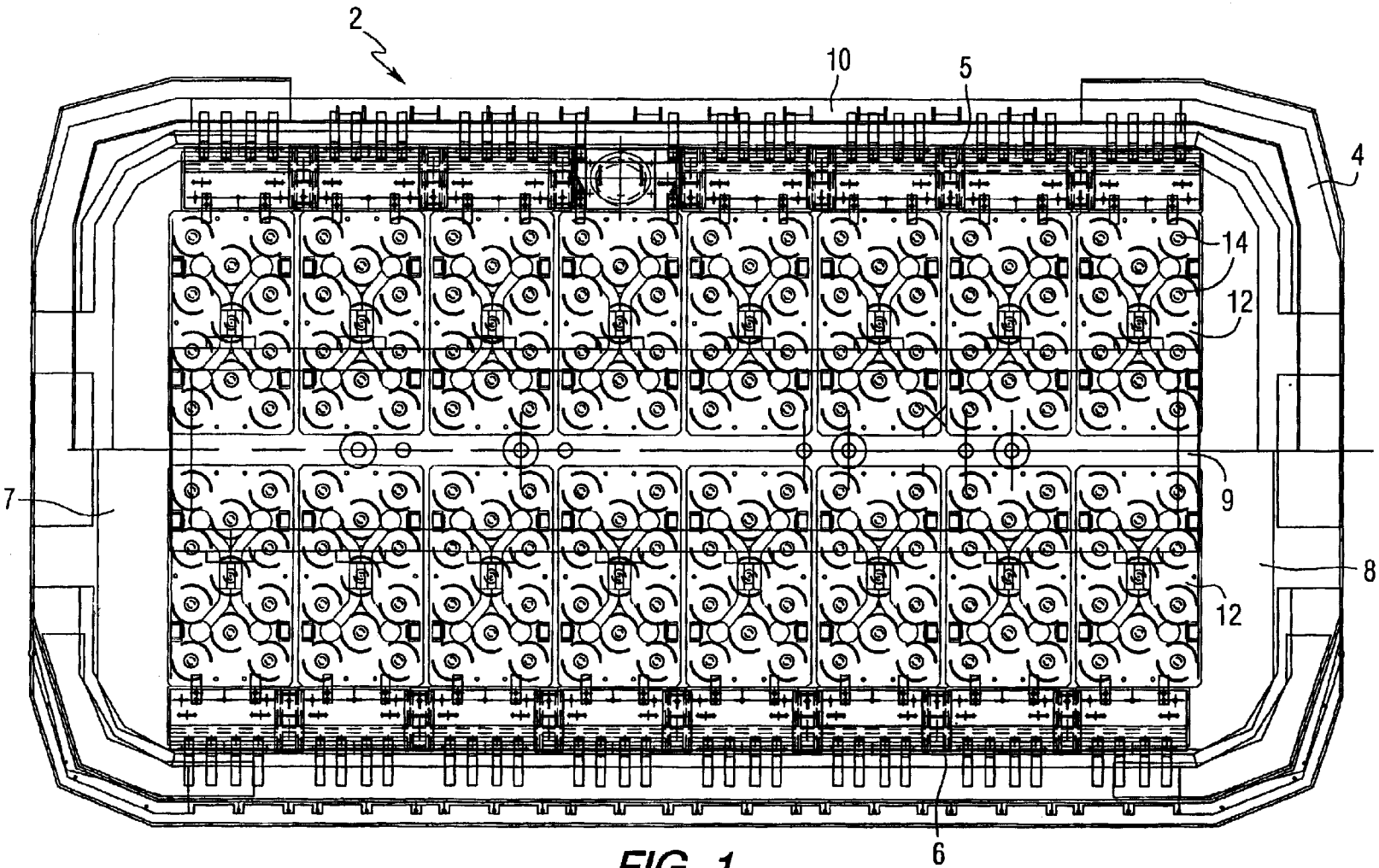
FIG. 1 is a plan view of an inert anode aluminum production cell including side insulation assemblies in accordance with an embodiment of the present invention.
Figure 2:
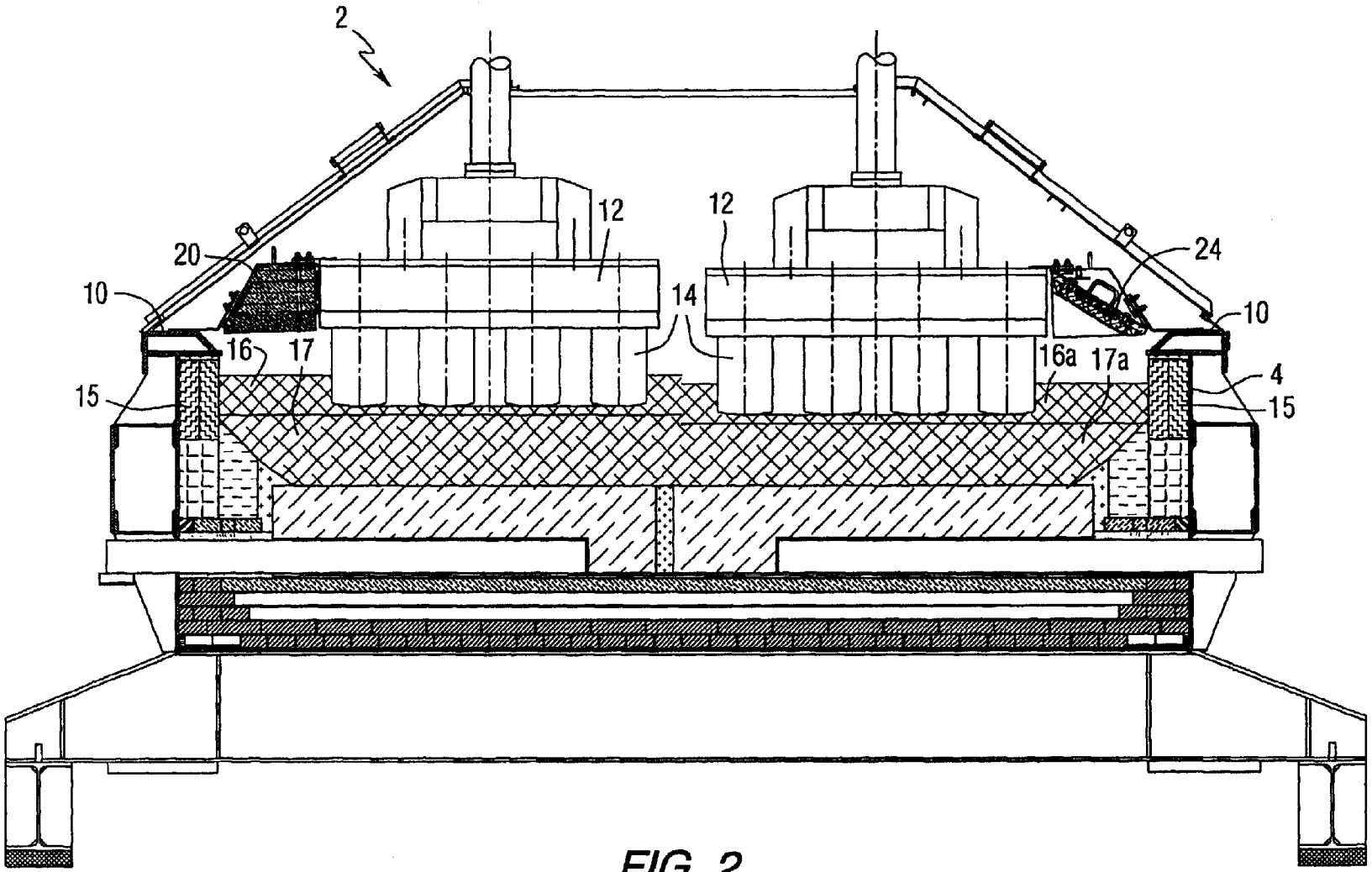
FIG. 2 is a sectional end view of the cell of FIG. 1.

FIG. 1 is a plan view and FIG. 2 is a sectional end view illustrating an aluminum production cell 2 in accordance with an embodiment of the present invention. The aluminum production cell 2 includes an electrolytic bath containment vessel 4 having side aisles 5 and 6, end aisles 7 and 8, and a center aisle 9. The vessel 4 comprises a deck plate 10 above side walls 15 of the vessel 4. As most clearly shown in FIG. 2, the deck plate 10 may comprise a separate metal plate supported by the side wall 15. Alternatively, the deck plate may be provided as an integral component of the side wall 15, or may be provided in any other known configuration used with conventional aluminum smelting cells.

As shown in FIGS. 1 and 2, inert anode assemblies 12 comprising multiple inert anodes 14 are positioned above the vessel 4. An electrolytic bath or electrolyte 16 and a molten aluminum pad 17 are contained in the vessel 4. As shown in FIG. 2, during operation of the aluminum production cell 2, the level of the electrolyte 16 may vary, e.g., as shown by the lower electrolyte level 16*a*. Similarly, the level of the molten aluminum pad 17 may vary, e.g., as shown by the lower molten aluminum pad 17*a*. As more fully described below, insulation assemblies in accordance with an embodiment of the present invention are capable of adjusting for such changes in electrolyte and aluminum pad levels.

In the embodiment shown in FIGS. 1 and 2, side insulation assemblies 20 are supported by the deck plate 10 and the inert anode assemblies 12 along the side aisles 5 and 6. As shown in FIG. 1, smaller side insulation assemblies 22 are supported by the larger side insulation assemblies 20. As also shown in FIG. 1, at least one tapping insulation assembly 24 may be provided along the side aisle 5, or at any other desired location. The tapping insulation assembly 24 is supported by the deck plate 10 and an inert anode assembly 12 in a similar manner as the side insulation assemblies 20.

As shown in FIG. 2, each of the side insulation and tapping insulation assemblies 20 and 24 are supported by the deck plate 10 and inert anode assemblies 12 in a manner which allows adjustment for vertical movement of the inert anode assemblies 12 during operation of the cell 2. For example, when an inert anode assembly 12 moves vertically from a relatively high position shown on the left of FIG. 2 to a relatively low position shown on the right of FIG. 2, the side insulation and tapping insulation assemblies 20 and 24 are capable of pivoting or rocking in order to adjust for such vertical movement of the inert anode assemblies 12.

Figure 3:
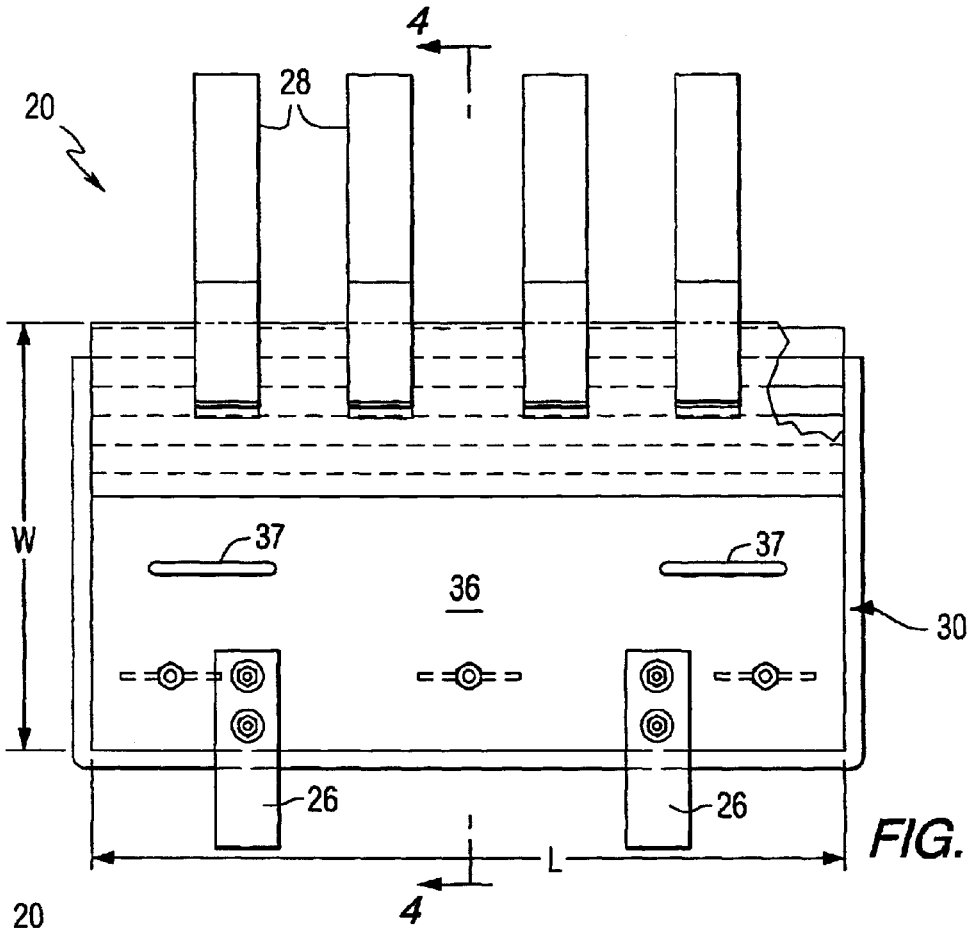
FIG. 3 is a top view of a side insulation assembly in accordance with an embodiment of the present invention.
Figure 4:
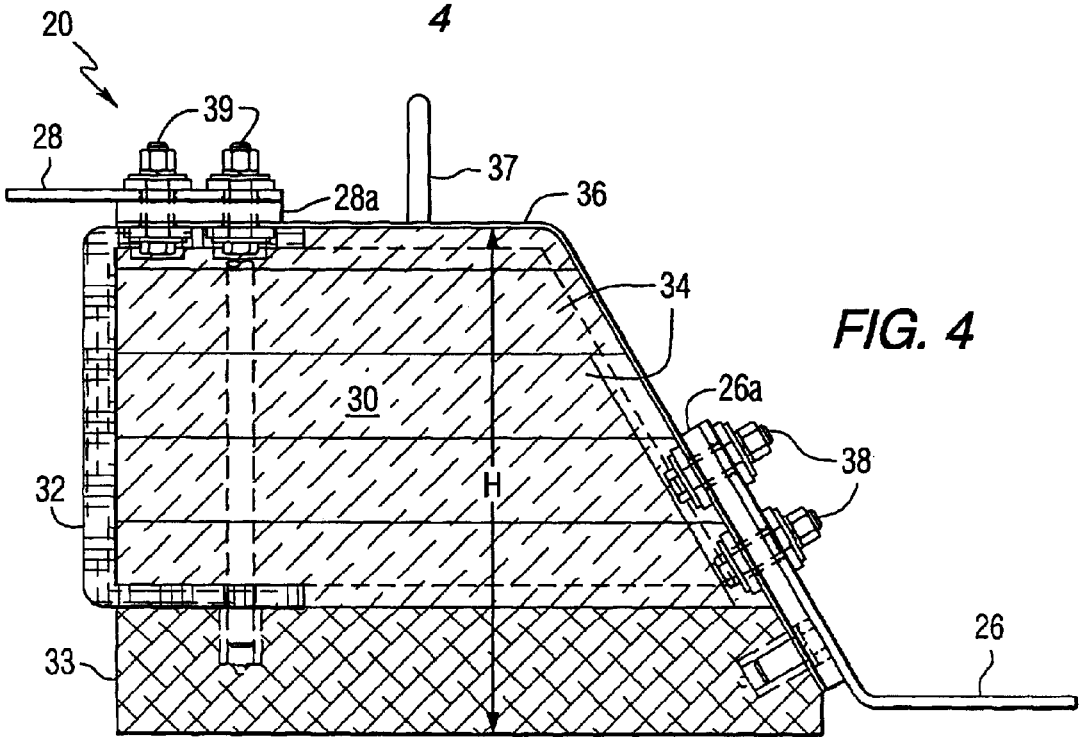
FIG. 4 is a side sectional view taken through line 4—4 of the side insulation assembly of FIG. 3.

FIG. 3 is a top view and FIG. 4 is a side sectional view of the side insulation assembly 20 in accordance with an embodiment of the present invention. In this embodiment, the side insulation assembly 20 comprises multiple deck plate support members 26 and multiple inert anode assembly support members 28 attached to insulation material 30. Although multiple support members 26 and 28 are shown in the embodiment of FIGS. 3 and 4, single support members could alternatively be used. Furthermore, when multiple support members are used, the side insulation assembly 20 may include any suitable number of such support members. The support members 26 and 28 may be made of any suitable material such as steel, stainless steel or Inconel.

As shown most clearly in FIG. 4, the deck plate support members 26 are electrically insulated from the inert anode assembly support members 28. Such electrical insulation may be achieved as shown in FIG. 4 through the use of electrically insulating pads 26*a* and 28*a* between each of the support members 26 and 28 and the remainder of the insulation assembly. Alternatively, at least the upper surface of the insulation material 30 may comprise an electrically insulating material which isolates the deck plate support members 26 from the inert anode assembly support members 28. In the embodiment shown in FIGS. 3 and 4, the side insulation assembly 20 comprises a protective cover 36 made of any suitable material such as steel, stainless steel or Inconel. A handle 37 may be attached to the protective cover 36, or at any other suitable location on the side insulation assembly 20.

As shown most clearly in FIG. 4, the insulation material 30 of the side insulation assembly 20 is supported by the deck plate support members 26 and the inert anode assembly support members 28. Mechanical fasteners 38 and 39 as shown in FIG. 4 may be used for securement to the insulation material 30. However, any other suitable means of attachment may be used.

In the embodiment shown in FIG. 4, the insulation material 30 comprises exterior and interior insulation portions comprising different insulating materials. An exterior insulating portion 32 is located on a side wall of the insulation assembly 20. The exterior side wall insulating portion 32 may comprise, for example, a blanket made from woven or mat material such as silica, aluminosilicates, alumina or mineral wool. The side insulation assembly 20 also includes an exterior bottom surface insulation portion 33 comprising, for example, a castable ceramic material such as aluminosilicates, alumina, silicon carbide, calcium aluminate and silicon nitride. The interior insulating portion 34 may comprise any suitable form of insulation, e.g., boards, blankets, loose fill and the like. In the embodiment shown in FIG. 4, the interior insulating portion 34 comprises multiple boards of insulating material such as calcium silicate.

The side insulation assembly 20 shown in FIGS. 3 and 4 typically has a length L of from about 40 to about 200 cm. The side insulation assembly 20 has a height H which typically ranges from about 10 to about 50 cm, and a width W which typically ranges from about 5 to about 80 cm. Preferably, the side insulation assembly 20 has a height H of from about 20 to about 40 cm, and a width W of from about 10 to about 60 cm.

Figure 6:
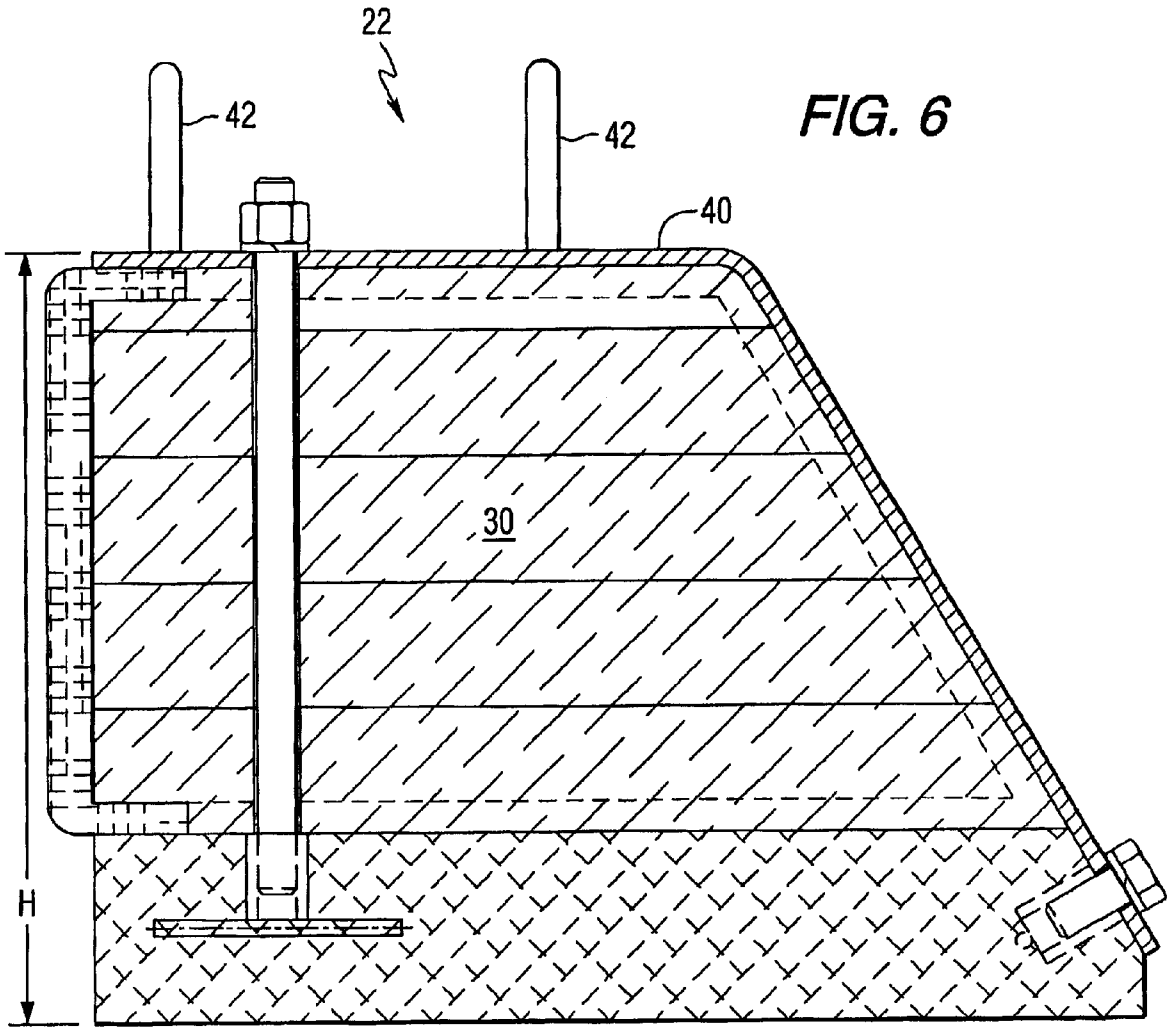
FIG. 6 is a side sectional view taken through line 6—6 of the small side insulation assembly of FIG. 5.
Figure 5:
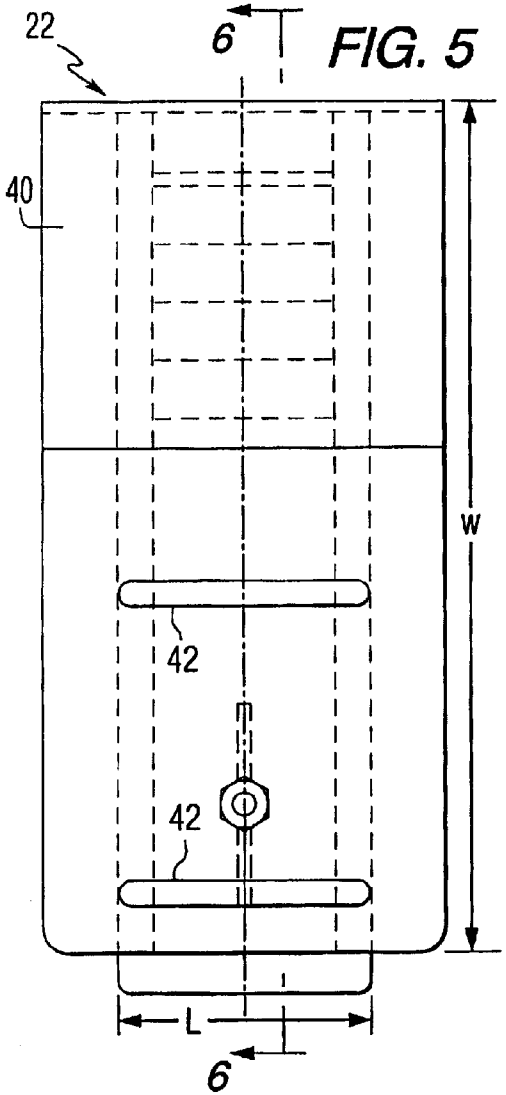
FIG. 5 is a top view of a small side insulation assembly in accordance with an embodiment of the present invention.

FIG. 5 is a top view and FIG. 6 is a side sectional view of the small insulation assembly 22. The small insulation assembly 22 includes an extended cover 40 which serves to support the assembly 22 when it is installed between adjacent side insulation assemblies 20, as shown in FIG. 1. The small insulation assembly 22 may comprise one or more handles 42 as shown in FIGS. 5 and 6.

The small insulation assembly 22 has a length L which typically ranges from about 5 to about 30 cm. The height H and width W of the small insulation assembly may be comparable to those of the side insulation assembly 20. In a preferred embodiment, the small insulation assembly 22 is sufficiently light in weight such that it may be installed and removed from the cell 2 by manual lifting. The small insulation assembly 22 preferably weighs less than about 30 kg, more preferably from about 5 to about 25 kg. In contrast, the larger side insulation assembly 20 typically weighs from about 30 to about 250 kg.

Figure 7:
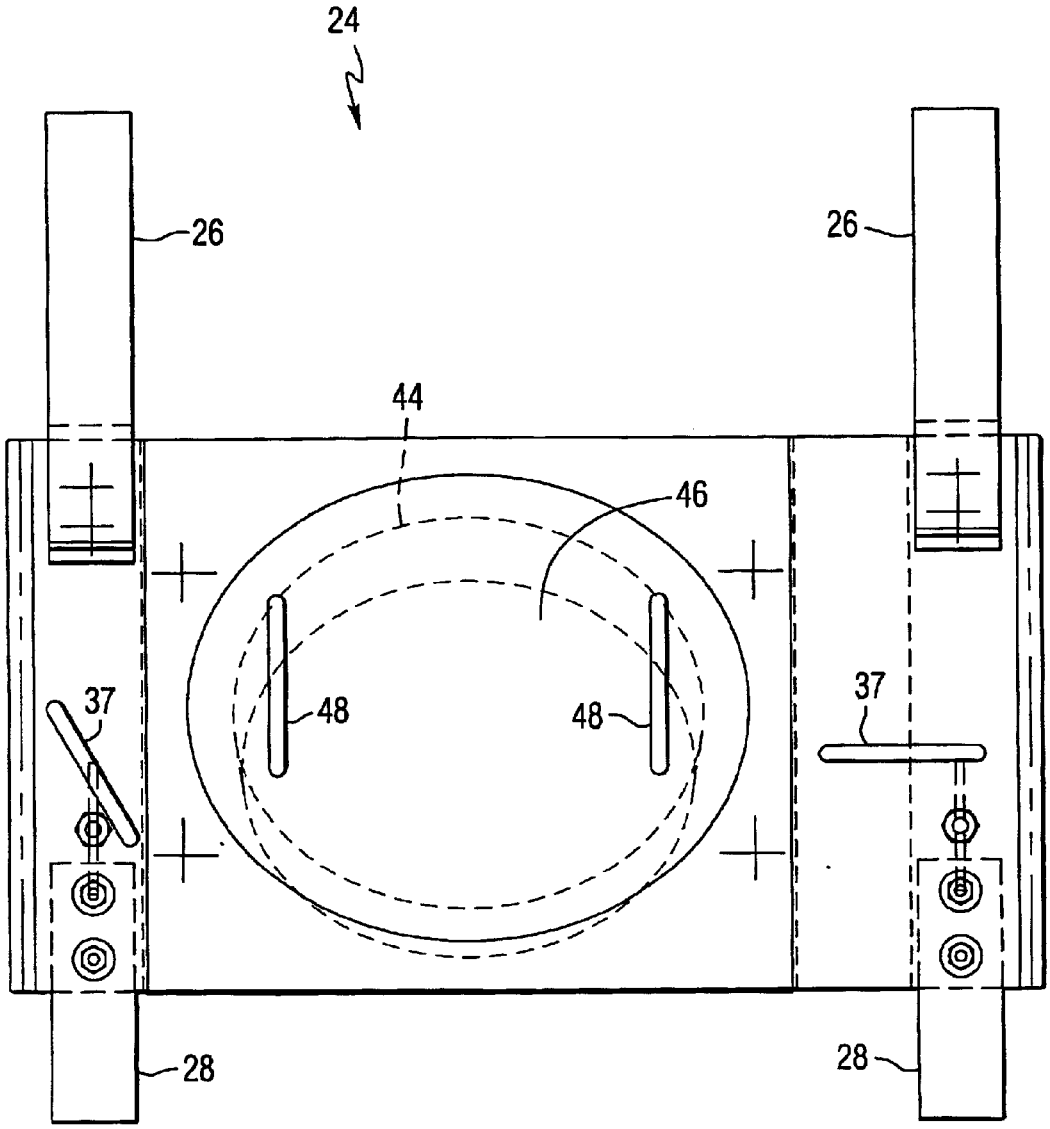
FIG. 7 is a top view of a side insulation assembly including a tapping hole in accordance with an embodiment of the present invention.
Figure 8:
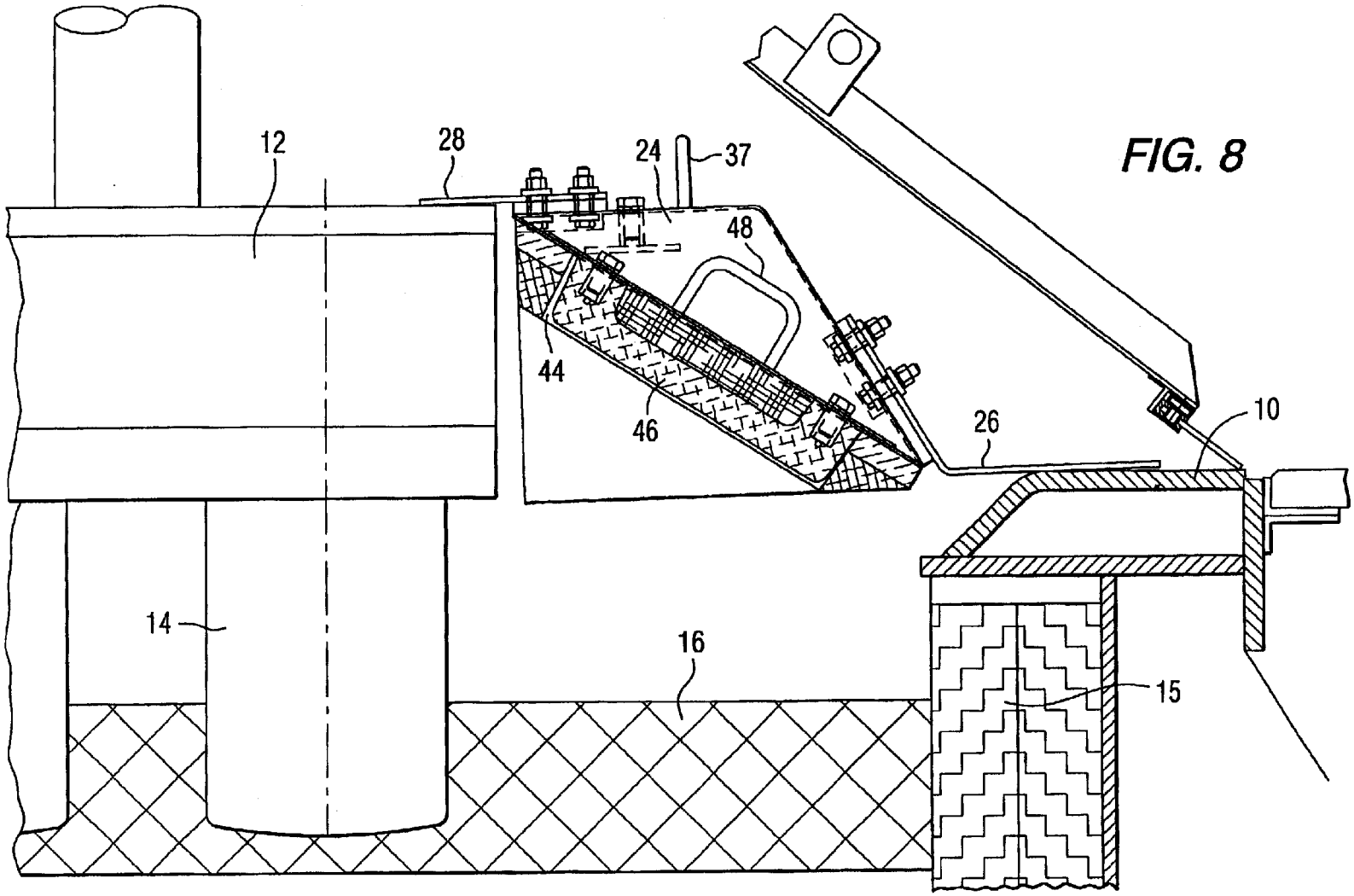
FIG. 8 is a side sectional view of the tapping hole side insulation assembly of FIG. 7 mounted on the side aisle of a portion of an aluminum production cell.

FIG. 7 is a top view of the tapping insulation assembly 24. FIG. 8 is a side sectional view showing the tapping insulation assembly 24 supported by the deck plate 10 and inert anode assembly 12 in the aluminum production cell. The tapping insulation assembly 24 comprises a tap hole 44 and a removable cover 46. A handle 48 is attached to the removable cover 46. The removable cover 46 may be made from a castable ceramic material such as aluminosilicates, alumina, silicon carbide, calcium aluminate and silicon nitride.

Figure 9:
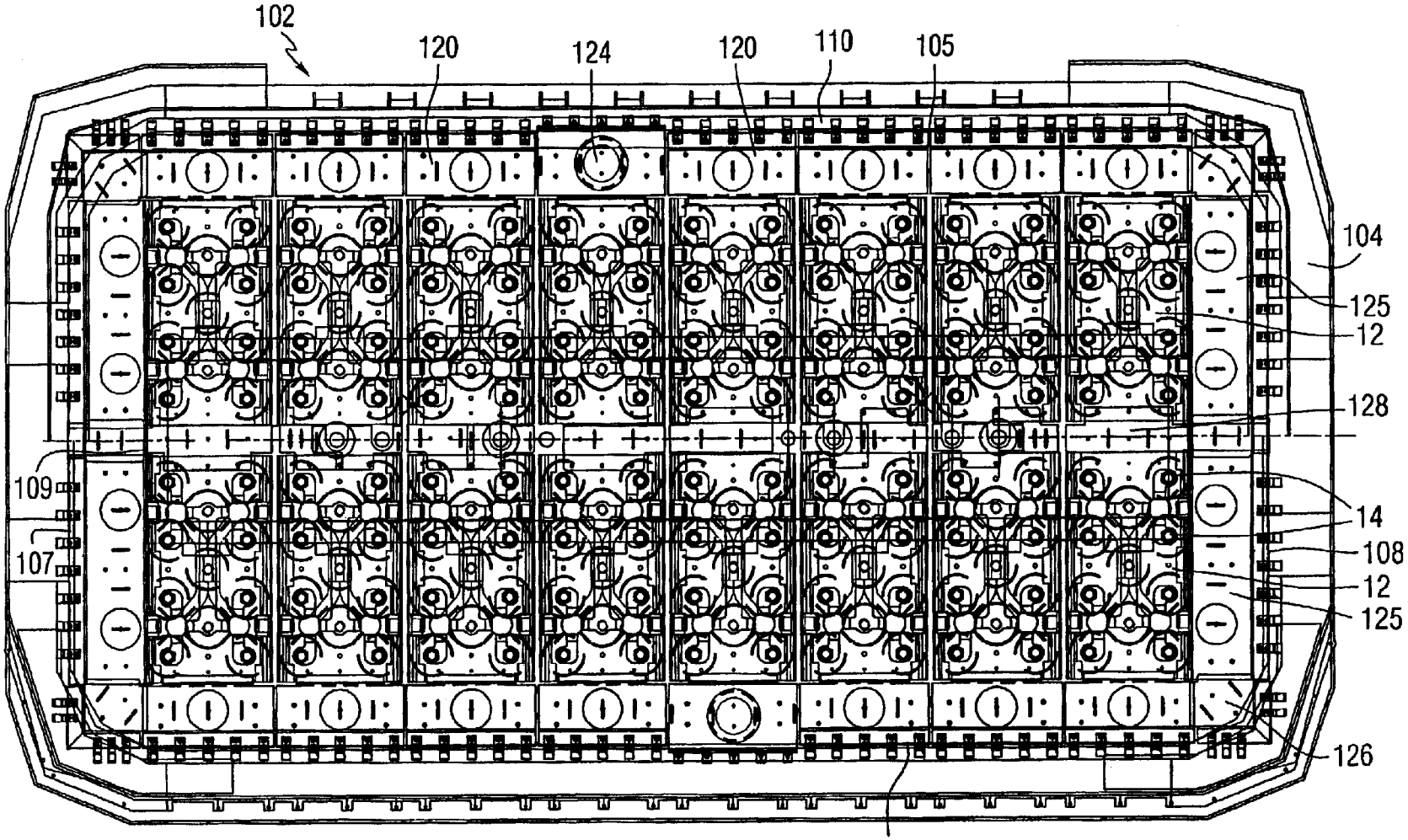
FIG. 9 is a plan view of an inert anode aluminum production cell including side, end and center insulation assemblies in accordance with another embodiment of the present invention.
Figure 10:
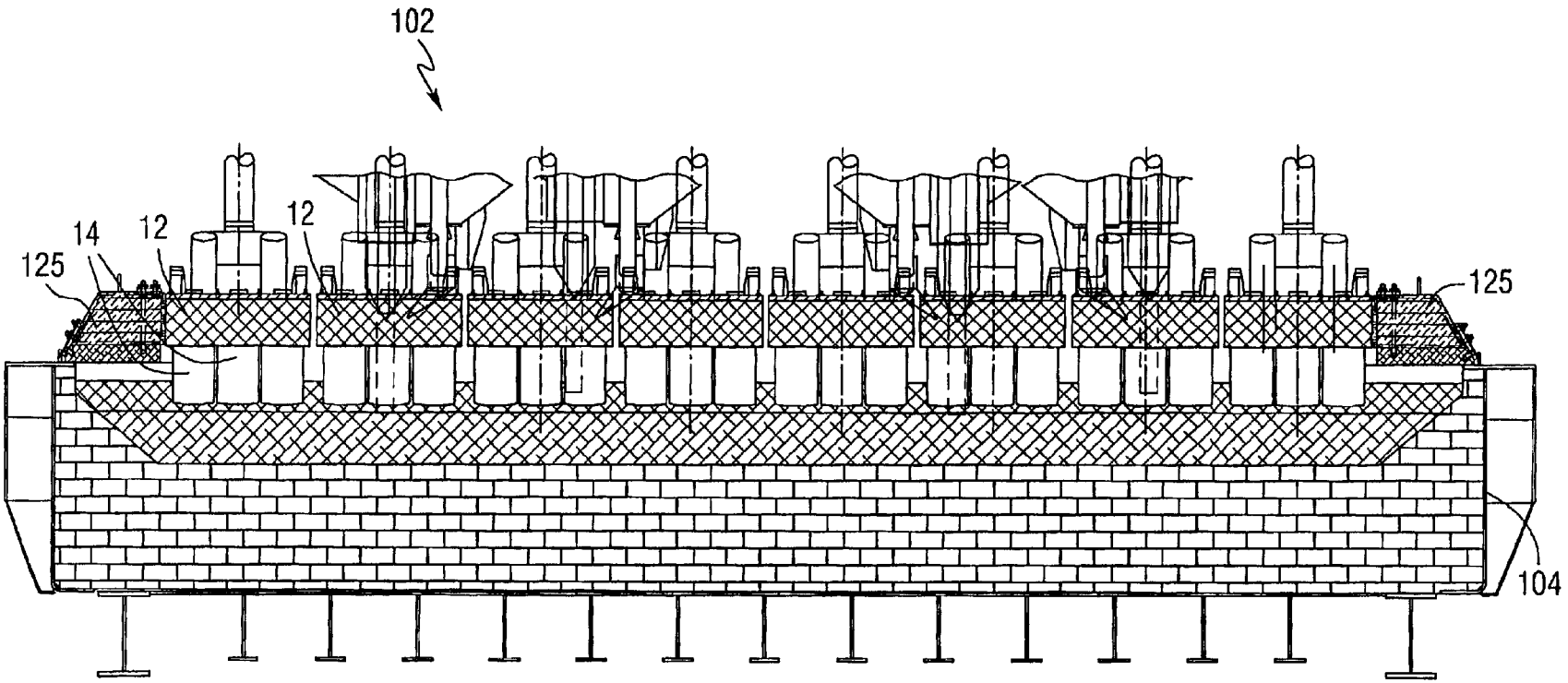
FIG. 10 is a sectional side view of the cell of FIG. 9.

FIG. 9 is a top view and FIG. 10 is a sectional side view of an inert anode aluminum production cell 102 in accordance with another embodiment of the present invention. The aluminum production cell 102, which is similar to the cell 2 shown in FIGS. 1 and 2, includes an electrolytic bath containment vessel 104 having side aisles 105 and 106, end aisles 107 and 108, and a center aisle 109. A deck plate 110 is provided on the vessel 104, in a similar manner as the embodiment shown in FIGS. 1 and 2. As shown in FIG. 9, side insulation assemblies 120, similar to the side insulation assemblies 20 shown in FIG. 1, are provided along the side aisles 105, 106 of the vessel 104. As also shown in FIG. 9, at least one tapping insulation assembly 124 is installed in the cell 102, similar to the tapping insulation assembly 24 shown in FIG. 1.

In the embodiment shown in FIGS. 9 and 10, in addition to the side insulation assemblies 120, the aluminum production cell 102 is provided with end insulation assemblies 125 along the end aisles 107 and 108, corner insulation assemblies 126, and center aisle insulation assemblies 128 along the center aisle 109. The end insulation assemblies 125 may be of similar construction as the side insulation assemblies 120 shown in FIG. 9 and the side insulation assemblies 20 shown in FIG. 1.

Figure 11:
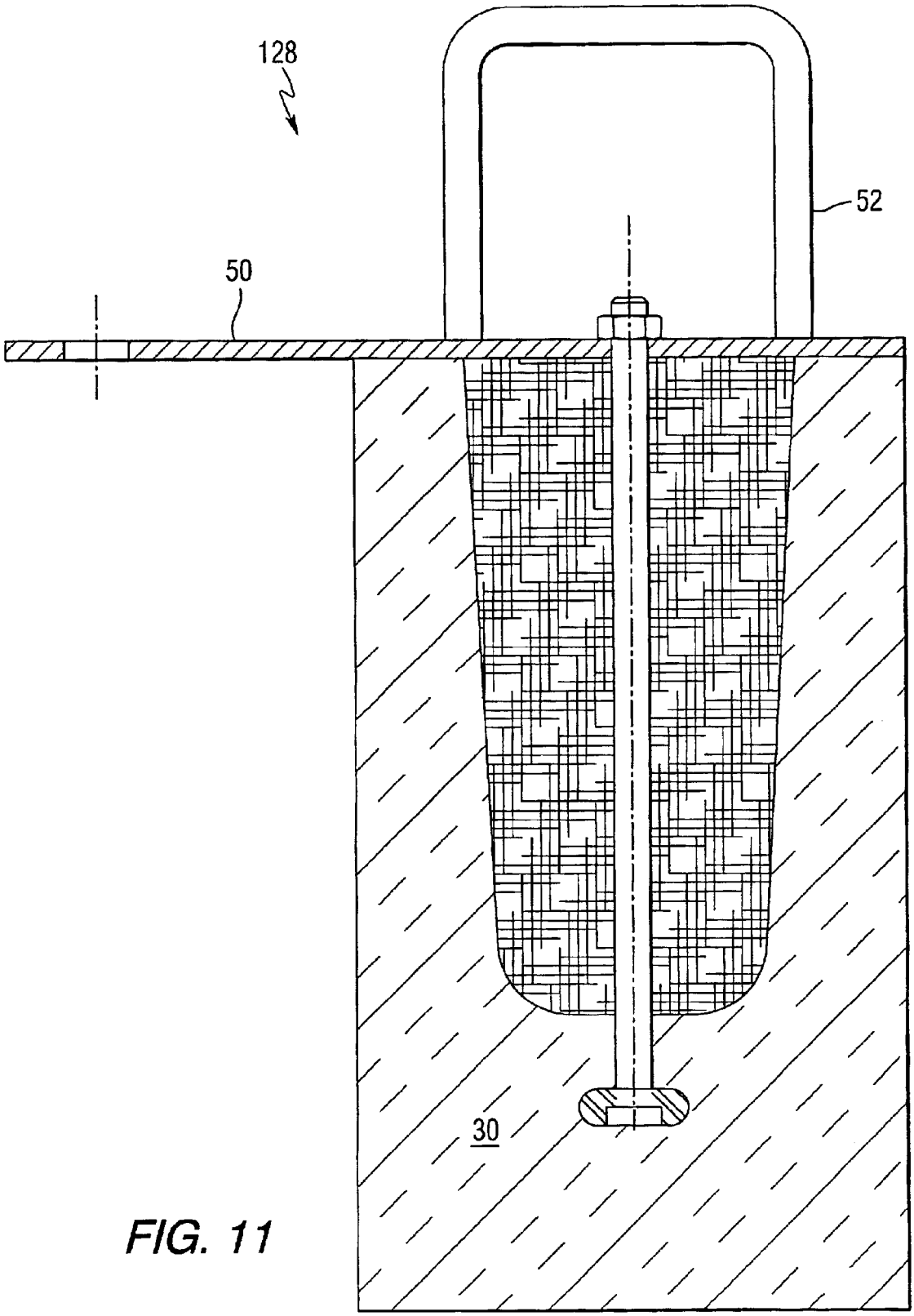
FIG. 11 is a side sectional view of a center insulation assembly in accordance with an embodiment of the present invention.

A side sectional view of the center aisle insulation assembly 128 is shown in FIG. 11. The center aisle insulation assembly 128 includes a support cover 50 which rests on an inert anode assembly 12 when the center aisle insulation assembly 128 is installed in the aluminum production cell 102. As shown in FIG. 11, a handle 52 may be attached to the center aisle insulation assembly 128.

Figure 13:
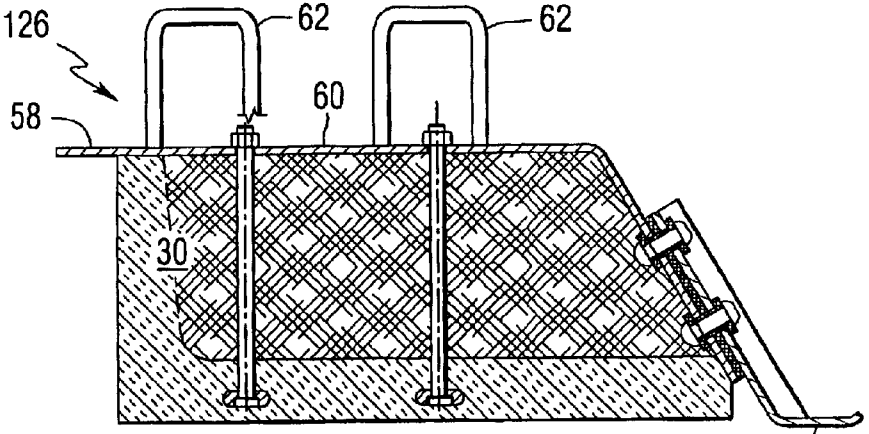
FIG. 13 is a sectional view taken through line 13—13 of FIG. 12.
Figure 14:
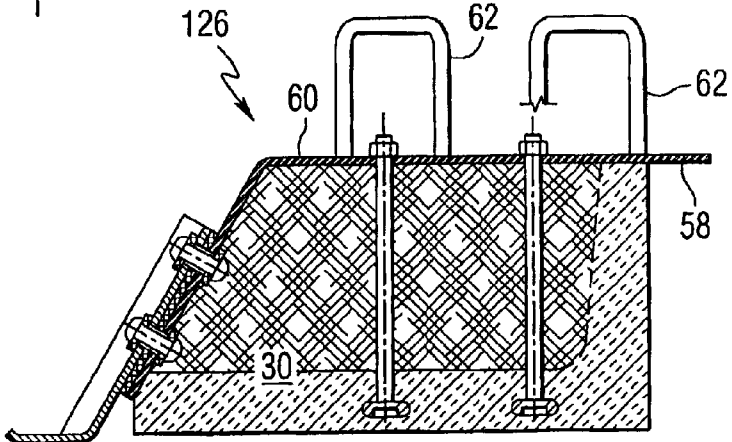
FIG. 14 is a sectional view taken through line 14—14 of FIG. 12.
Figure 12:
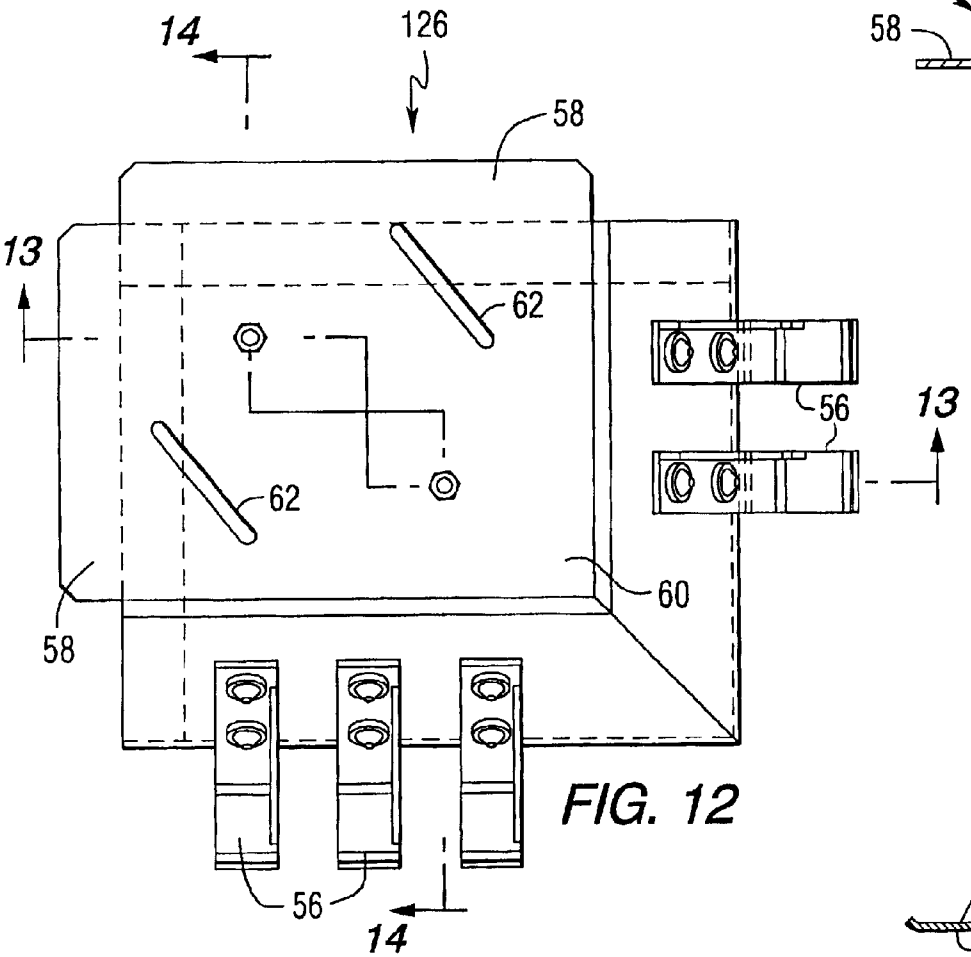
FIG. 12 is a top view of a corner insulation assembly in accordance with an embodiment of the present invention.

FIG. 12 is a top view and FIGS. 13 and 14 are sectional views of the corner insulation assembly 126. The corner insulation assembly 126 is basically a modification of the side insulation assembly 120 adapted for installation at the corners of the vessel 104. The corner insulation assembly 126 includes an inert anode assembly support member 58, as well as multiple deck plate support members 56. The corner insulation assembly 126 also includes handles 62 attached to a protective cover 60.

The metal production cells 2 and 102 in which the present insulating assemblies may be installed may consist of a conventional Hall-Heroult design, with a cathode and insulating material enclosed in a steel shell. Each inert anode assembly 12 is attached to a bridge in a known manner. The inert anode assemblies 12 may consist of a metallic distributor plate which distributes current to the array of anodes 14 through a metallic conductor pin. The inert anode assemblies 12 may each include multiple inert anodes 14, e.g., as shown in FIGS. 1, 2, 9 and 10. In the embodiments described herein, the cell 2 or 102 contains an array of eleven inert anode assemblies 12. However, any other suitable number of inert anode assemblies may be used. Each assembly may replace a single consumable carbon anode of the cell.

Any desired inert anode shape or size may be used. For example, the substantially cylindrical cup-shaped inert anodes 14 may have diameters of from about 5 to about 30 inches and heights of from about 5 to about 20 inches. The composition of each inert anode 14 may include any suitable metal, ceramic, cermet, etc. which possesses satisfactory corrosion resistance and stability during the aluminum production process. For example, inert anode compositions disclosed in U.S. Pat. Nos. 4,374,050, 4,374,761, 4,399,008, 4,455,211, 4,582,585, 4,584,172, 4,620,905, 5,794,112, 5,865,980, and 6,217,739, and U.S. patent application Ser. No. 09/629,332 filed Aug. 1, 2000, each of which is incorporated herein by reference, may be suitable for use in the inert anodes 14. Particularly preferred inert anode compositions comprise cermet materials including an Fe—Ni—Zn oxide or Fe—Ni—Co oxide phase in combination with a metal phase such as Cu and/or Ag. Each inert anode 14 may comprise a uniform material throughout its thickness, or may include a more corrosion resistant material in the regions exposed to the electrolytic bath.

The anode connectors of the assemblies 12 may be made of suitable materials which provide sufficient electrical conductivity and mechanical support for the inert anodes. For example, each connector may be made of Inconel. Optionally, a highly conductive metal core such as copper may be provided inside an Inconel sleeve. The connectors may be attached to the inert anodes 14 by any suitable means such as brazing, sintering and mechanical fastening. For example, a connector comprising an Inconel sleeve and a copper core may be attached to a cup-shaped inert anode by filling the bottom of the inert anode with a mixture of copper powder and small copper beads, followed by sintering of the mixture to attach the copper core to the inside of the anode. Each connector may optionally include separate components for providing mechanical support and supplying electrical current to the inert anodes.

In accordance with a preferred embodiment, additional insulation may be used within the anode assemblies 12 in order to conserve more of the heat presently lost from conventional cells, while at the same time avoiding undesirable increases in total voltage. An insulation package (not shown in detail) may be installed on top of each assembly 12 which can survive under severe conditions. The insulating package preferably includes one or more thermal insulating layers of any suitable composition(s). For example, a highly corrosion resistant refractory insulating material may be provided on the exposed regions of the insulating package, while a material having higher thermal insulation properties may be provided in the interior regions. The insulating package may also include an electrically conductive metal plate (not shown) which provides a current path from the conductive support member to the connectors. In one embodiment, an insulating package consisting of a castable ceramic enclosure filled with insulating material(s) may be provided between the plate and anodes. The ceramic enclosure may be supported by the metal distributor plate, which may be attached to existing anode rods and stubs common to conventional carbon anodes. The conductive metal plate may be at least partially covered with a thermally insulating and/or corrosion resistant material (not shown). Electrically conductive elements such as copper straps may optionally be provided between the conductive support member and connectors.

Advantages of the side aisle, end aisle and center aisle insulation assemblies of the present invention include reduced heat loss, reduced bath vapor losses, and thermally stable cell operation.

Having described the presently preferred embodiments, it is to be understood that the invention may be otherwise embodied within the scope of the appended claims.

What is claimed is:

1. A metal production cell comprising:

an electrolytic bath containment vessel comprising a wall defining a deck plate;

at least one inert anode assembly mounted over the vessel; and at least one insulation assembly located along a side aisle or end aisle of the vessel and supported by the at least one anode assembly and the deck plate, wherein the at least one insulation assembly includes means for adjusting for movement of the at least one inert anode assembly in relation to the deck plate.

2. The metal production cell of claim 1, wherein the adjusting means comprises means for permitting rocking movement of the at least one insulation assembly upon a substantially vertical movement of the at least one inert anode assembly in relation to the deck plate.

3. The metal production cell of claim 1, wherein the metal production cell comprises a plurality of the insulation assemblies positioned adjacent each other.

4. The metal production cell of claim 3, further comprising another smaller insulation assembly between the adjacent insulation assemblies.

5. The metal production cell of claim 4, wherein the smaller insulation assembly is supported by the adjacent insulation assemblies.

6. The metal production cell of claim 4, wherein the smaller insulation assembly has a length of from about 5 to about 30 cm.

7. The metal production cell of claim 6, wherein the adjacent insulation assemblies each have a length of from about 40 to about 200 cm.

8. The metal production cell of claim 4, wherein the smaller insulation assembly weighs less than about 30 kg.

9. The metal production cell of claim 8, wherein the smaller insulation assembly weighs from about 5 to about 25 kg.

10. The metal production cell of claim 8, wherein the adjacent insulation assemblies each weigh from about 30 to about 250 kg.

11. The metal production cell of claim 1, wherein the at least one insulation assembly comprises at least one deck plate support member and at least one inert anode assembly support member which are electrically insulated from each other.

12. The metal production cell of claim 1, wherein the cell is an aluminum production cell.

13. An insulation assembly for an aluminum production cell, the insulation assembly comprising:

at least one deck plate support member;

at least one inert anode assembly support member; and insulation material connected to the at least one deck plate support member and the at least one inert anode assembly support member, wherein the at least one deck plate support member, the at least one inert anode assembly support member and the insulation material are structured and arranged to allow for adjustable movement of the insulation assembly in relation to a deck plate of the aluminum production cell.

14. The insulation assembly of claim 13, wherein the at least one deck plate support member and the at least one inert anode assembly support member are electrically insulated from each other.

15. The insulation assembly of claim 13, wherein the at least one deck plate support member comprises a substantially horizontal portion extending from the insulation material adapted for contact with a deck plate of the aluminum production cell.

16. The insulation assembly of claim 13, wherein the at least one deck plate support member comprises a metal selected from steel, stainless steel and Inconel.

17. The insulation assembly of claim 13, wherein the insulation assembly comprises a plurality of the deck plate support members.

18. The insulation assembly of claim 13, wherein the at least one inert anode assembly support member comprises a substantially horizontal portion extending from the insulation material adapted for contact with an inert anode assembly of the aluminum production cell.

19. The insulation assembly of claim 13, wherein the at least one inert anode assembly support member comprises a metal selected from steel, stainless steel and Inconel.

20. The insulation assembly of claim 13, wherein the insulation assembly comprises a plurality of the inert anode assembly support members.

21. The insulation assembly of claim 13, wherein the at least one deck plate support member comprises a substantially flat portion extending from the insulation material, and the at least one inert anode assembly support member comprises a substantially flat portion extending from the insulation material.

22. The insulation assembly of claim 21, wherein the flat portions of the deck plate and inert anode assembly support members extend in substantially parallel planes.

23. The insulation assembly of claim 22, wherein the flat portion of the deck plate support member extends in a plane below the plane of the flat portion of the inert anode assembly support member.

24. The insulation assembly of claim 13, wherein the insulation material comprises exterior and interior insulation portions comprising different insulating materials.

25. The insulation assembly of claim 24, wherein the exterior insulating portion is located on a side wall of the insulation assembly.

26. The insulation assembly of claim 25, wherein the exterior side wall insulating portion comprises a blanket comprising at least one material selected from silica, aluminosilicates, alumina and mineral wool.

27. The insulation assembly of claim 24, wherein the exterior insulation portion is located on a bottom surface of the insulation assembly.

28. The insulation assembly of claim 27, wherein the exterior bottom surface insulation portion comprises a castable ceramic comprising at least one material selected from aluminosilicates, alumina, silicon carbide, calcium aluminate and silicon nitride.

29. The insulation assembly of claim 24, wherein the interior insulating portion comprises multiple boards of material.

30. The insulation assembly of claim 29, wherein the interior insulating portion comprises calcium silicate.

31. The insulation assembly of claim 13, wherein the at least one deck plate support member and the at least one inert anode assembly support member are secured to the insulation material by mechanical fasteners.

32. The insulation assembly of claim 13, wherein at least a portion of the insulation material is covered by a protective cover.

33. The insulation assembly of claim 32, wherein the protective cover comprises at least one metal selected from steel, stainless steel and Inconel.

34. The insulation assembly of claim 13, further comprising at least one lift handle attached to the insulation assembly.

35. The insulation assembly of claim 13, wherein the insulation assembly has a height of from about 10 to about 50 cm and a width of from about 5 to about 80 cm.

36. The insulation assembly of claim 13, wherein the insulation assembly has a height of from about 20 to about 40 cm and a width of from about 10 to about 60 cm.

37. The insulation assembly of claim 13, wherein the insulation assembly has a length of from about 40 to about 200 cm.

38. The insulation assembly of claim 13, wherein the insulation assembly weighs from about 30 to about 250 kg.

39. The insulation assembly of claim 13, wherein the insulation assembly is adapted for installation along a side aisle of the aluminum production cell.

40. The insulation assembly of claim 13, wherein the insulation assembly is adapted for installation along an end aisle of the aluminum production cell.

41. The insulation assembly of claim 13, wherein the insulation assembly is adapted for installation at a corner of the aluminum production cell.

42. The insulation assembly of claim 13, wherein the insulation assembly comprises a tap hole through at least a portion of the assembly.

43. The insulation assembly of claim 42, wherein the insulation assembly comprises a removable cover for the tap hole.

44. The insulation assembly of claim 43, wherein the removable cover comprises a handle.

45. The insulation assembly of claim 43, wherein the removable cover comprises a castable ceramic comprising at least one material selected from aluminosilicates, alumina, silicon carbide, calcium aluminate and silicon nitride.

46. A method of thermally insulating a metal production cell, the method comprising:

providing an electrolytic bath containment vessel;

providing at least one anode assembly comprising at least one inert anode over the vessel; and installing at least one insulation assembly along a side aisle or an end aisle of the vessel supported by the at least one anode assembly, wherein the electrolytic bath containment vessel comprises a wall defining a deck plate, and the at least one anode assembly is further supported by the deck plate.

47. The method of claim 46, wherein the cell is an aluminum production cell.

48. A metal production cell comprising:

an electrolytic bath containment vessel comprising a wall defining a deck plate;

at least one inert anode assembly mounted over the vessel; and at least one insulation assembly located along a side aisle or end aisle of the vessel and supported by the at least one anode assembly and the deck plate, wherein the at least one insulation assembly comprises at least one deck plate support member and at least one inert anode assembly support member which are electrically insulated from each other.

49. An insulation assembly for an aluminum production cell, the insulation assembly comprising:

at least one deck plate support member;

at least one inert anode assembly support member; and insulation material connected to the at least one deck plate support member and the at least one inert anode assembly support member, wherein the at least one deck plate support member comprises a substantially flat portion extending from the insulation material, and the at least one inert anode assembly support member comprises a substantially flat portion extending from the insulation material.

50. An insulation assembly for an aluminum production cell, the insulation assembly comprising:

at least one deck plate support member;

at least one inert anode assembly support member; and insulation material connected to the at least one deck plate support member and the at least one inert anode assembly support member, wherein the insulation material comprises exterior and interior insulation portions comprising different insulating materials, and the exterior insulating portion comprises a blanket located on a side wall of the insulation assembly.

51. An insulation assembly for an aluminum production cell, the insulation assembly comprising:

at least one deck plate support member;

at least one inert anode assembly support member;

insulation material connected to the at least one deck plate support member and the at least one inert anode assembly support member; and at least one lift handle attached to the insulation assembly.

52. An insulation assembly for an aluminum production cell, the insulation assembly comprising:

at least one deck plate support member;

at least one inert anode assembly support member; and insulation material connected to the at least one deck plate support member and the at least one inert anode assembly support member, wherein the insulation assembly has a length of from about 40 to about 200 cm.

53. An insulation assembly for an aluminum production cell, the insulation assembly comprising:

at least one deck plate support member;

at least one inert anode assembly support member; and insulation material connected to the at least one deck plate support member and the at least one inert anode assembly support member, wherein the insulation assembly weighs from about 30 to about 250 kg.

54. An insulation assembly for an aluminum production cell, the insulation assembly comprising:

at least one deck plate support member;

at least one inert anode assembly support member; and insulation material connected to the at least one deck plate support member and the at least one inert anode assembly support member, wherein the insulation assembly comprises a tap hole through at least a portion of the assembly and a removable cover for the tap hole.

* * * * *